US006726055B1

(12) United States Patent
Jackson

(10) Patent No.: US 6,726,055 B1
(45) Date of Patent: Apr. 27, 2004

(54) HAND SHIELD DISPENSER AND DISPOSAL SYSTEM

(76) Inventor: Horace L. Jackson, 200 Ward La., Williamstown, NJ (US) 08094

( * ) Notice: Subject to any disclaimer, the term of this patent is extended or adjusted under 35 U.S.C. 154(b) by 120 days.

(21) Appl. No.: 10/174,936

(22) Filed: Jun. 19, 2002

(51) Int. Cl.[7] ..... A47K 10/24
(52) U.S. Cl. ..... 221/45; 221/97
(58) Field of Search ..... 221/45, 46, 49, 221/61, 33, 34, 97, 287, 278; 15/208, 227

(56) References Cited

U.S. PATENT DOCUMENTS 2,566,016 A 8/1951 Cochran
3,885,835 A 5/1975 Breeden
4,919,302 A 4/1990 McPherson
5,083,704 A 1/1992 Rounthwaite
5,687,875 A 11/1997 Watts et al.
5,987,645 A 11/1999 Teaster
6,237,805 B1 5/2001 Katsanevas

*Primary Examiner*—Kenneth W. Noland
(74) *Attorney, Agent, or Firm*—Norman E. Lehrer

(57) ABSTRACT

The combination of a door and a dispenser for storing hand shields including a door for a generally enclosed area with a front side and a back side and the dispenser including a plurality of housings is disclosed. The dispenser is mounted in the vicinity of the back side of the door. A plurality of hand shields are stored within each of the housings and each of the housings has an opening through which the shields are dispensed. A disposal passage extends from inside the enclosed area to outside the enclosed area and has an opening in the vicinity of the front side of the door. A receptacle is in communication with the disposal passage and has a vacuum source for collecting and housing used shields. In one embodiment the receptacle is mounted to the door. In another embodiment the receptacle is positioned at a location remote from the door.

10 Claims, 2 Drawing Sheets

HAND SHIELD DISPENSER AND DISPOSAL SYSTEM

BACKGROUND OF THE INVENTION

The present invention is directed toward a hand shield to be used in a restroom and more particularly, toward a dispenser that provides the hand shields and a vacuum disposal system for disposing of used hand shields.

Germs are present on many surfaces, especially on door knobs or handles found in public restrooms, hospital rooms, doctors' offices, and the like. While washing one's hands is a common way to remove germs therefrom as well as to prevent the spread of germs, it is not always very effective. For example, after washing one's hands in a public restroom, a person must exit the room which quite often requires the person to come into contact with a door knob. Thus, it is very likely that the hands that were just washed will again come in contact with germs.

There are patents that address this problem and have proposed solutions. For example, U.S. Pat. No. 5,987,645 to Teaster discloses a glove-type of shield, a plurality of which may be stored in a dispenser and used in a public restroom so that a person may use the glove in order to open the door after washing his/her hands, thereby preventing the spread of germs. A problem with these gloves, however, is that there is no place to dispose of the used glove upon exiting the restroom.

U.S. Pat. No. 6,237,805 to Katsanevas addresses the disposal problem discussed above with regard to the patent to Teaster. Katsanevas discloses a towelette dispenser located on or near the door of a restroom so that the towelette may be used to open the door in order to prevent the spread of germs. The device also includes a collection bin into which used towelettes may be disposed. While this patent provides a solution to the problem of where to dispose of a used hand cover after the restroom door has been opened, the device appears to allow for some contact by the person's clean hand with the collection bin or with other used towelettes, particularly if the bin has not been emptied in a timely manner and is overflowing.

Therefore, a need exists for a hand shield dispenser and disposal system that prevents the spread of germs in an effective manner.

SUMMARY OF THE INVENTION

The present invention is designed to overcome the deficiencies of the prior art discussed above. It is an object of the present invention to provide a hand shield dispenser and disposal system.

It is another object of the present invention to provide a vacuum disposal system for a used hand shield.

In accordance with the illustrative embodiments demonstrating features and advantages of the present invention, there is provided the combination of a door for a generally enclosed area and a dispenser for storing hand shields comprising a door having a front side and a back side and a dispenser including a plurality of housings. The dispenser is mounted in the vicinity of the back side of the door and a plurality of hand shields are stored within each of the housings. Each of the housings has means for dispensing the shields. A disposal passage extends from inside the enclosed area to outside the enclosed area and has an opening in the vicinity of the front side of the door. A receptacle is in communication with the disposal passage and has a vacuum source located therein for collecting and housing used hand shields.

Other objects, features, and advantages of the invention will be readily apparent from the following detailed description of the preferred embodiments thereof taken in conjunction with the drawings.

BRIEF DESCRIPTION OF THE DRAWINGS

For the purpose of illustrating the invention, there is shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 2:
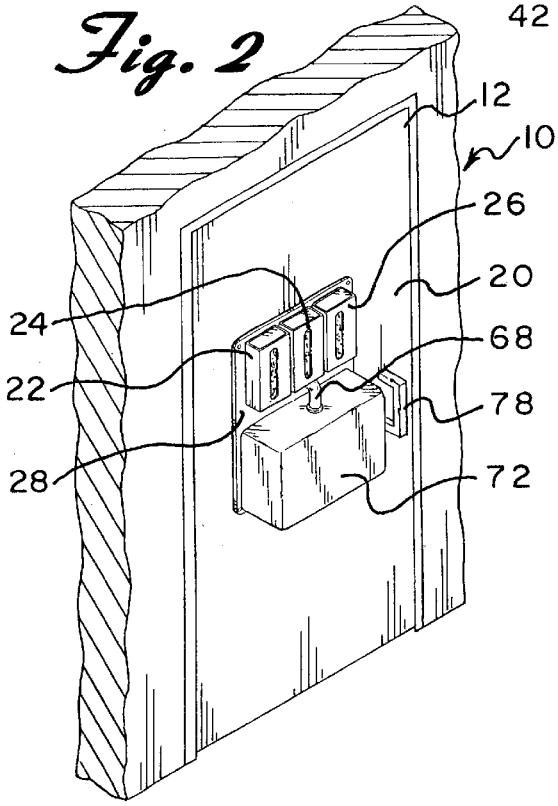
FIG. 2 illustrates the back side of a door with the dispenser and disposal system mounted thereto.

Referring now to the drawings in detail wherein like reference numerals have been used throughout the various figures to designate like elements, there is shown in FIG. 2, a first embodiment of the hand shield dispenser and disposal system constructed in accordance with the principles of the present invention and designated generally as 10.

The present invention essentially includes the combination of a door 12 for a generally enclosed area such as a public restroom or the like and a dispenser 14 for storing a plurality of hand shields 16. The door 12 has a front side 18 located outside of the restroom and a back side 20 located within the restroom. The dispenser 14 includes a plurality of preferably transparent plastic housings 22, 24, and 26 mounted to a plastic backing 28, which in turn, is mounted in the vicinity of the back side 20 of the door 12. Alternatively, each housing 22, 24, and 26 may be mounted directly to the door 12. In all cases, however, the materials from which the dispenser and disposable system are made are preferably lightweight.

Figure 3:
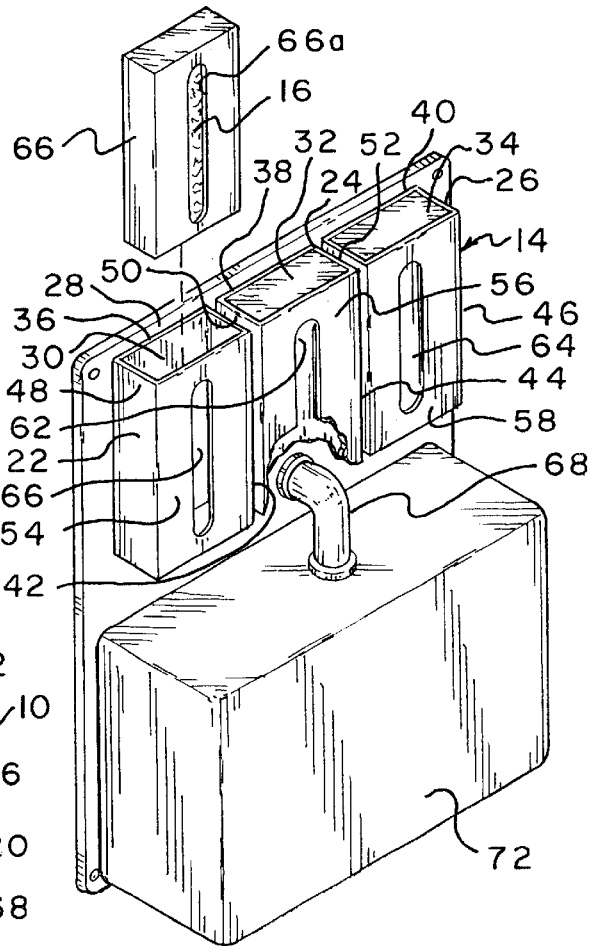
FIG. 3 is a front perspective view of the dispenser and disposal system of the present invention.

Each housing 22, 24, and 26 may be generally rectangular with an open top end 30, 32, and 34, respectively, or an opening within the top end, a back wall 36, 38, and 40, respectively, that is mounted to the backing 28 or back side 20 of the door 12, a right side wall 42, 44, and 46, a left side wall 48, 50, and 52, and a front wall 54, 56, and 58. The front wall 54, 56, and 58 includes means for dispensing the hand shields, such as an elongated opening 60, 62, and 64. A plurality of hand shields are stored within each of the housings in a manner typically known in the art where only one shield is dispensed at a time. Hand shields may include, for example, tissues, towelettes, paper or plastic gloves, paper towels, etc. The hand shields may be stored in boxes or containers, shown for example, as box 66, that fit within the housing 22 through the open top 30. (See FIG. 3.) The box 66 has an elongated opening 66*a* that aligns with the elongated opening 60 of the housing 22, for example, when the box 66 is placed within the housing 22.

Figure 4:
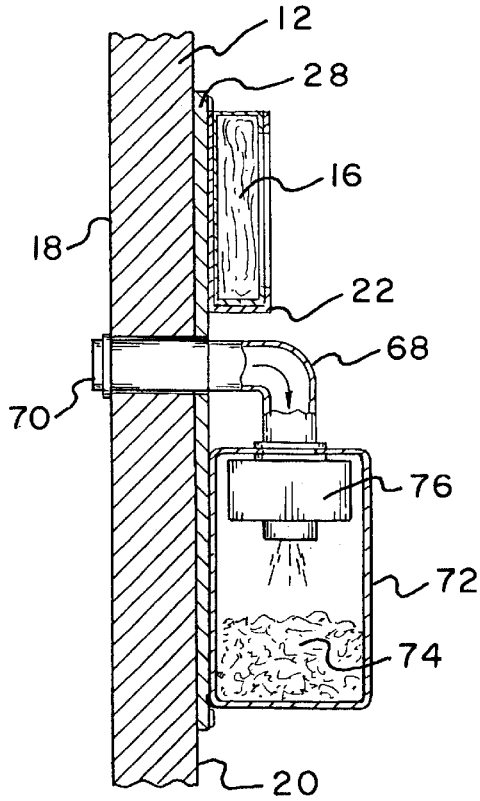
FIG. 4 is a partial cross-sectional view of a first embodiment of the present invention where the vacuum disposal receptacle is connected to the door.

A disposal passage 68 extends from inside the enclosed area to the outside of the enclosed area, for example, through the door 12 and the backing 28 and has an opening 70 in the vicinity of the front side 18 of the door 12. (See FIG. 4.) The passage 68 may be in the form of a hose made from rubber or like material. The hose 68 connects to and is in communication with a receptacle 72 which houses used hand shields 74. Located within the receptacle 72 is a vacuum source 76 for collecting the used hand shields 74 as will be described in greater detail below. The receptacle 72 is mounted to the backing 28, generally below the housings 22, 24, and 26 and preferably is made from a transparent plastic so that the contents can be viewed. Alternatively, and similar to the housings, the receptacle 72 may be mounted directly to the door 12. The receptacle may be enclosed and may be lined with a bag that is replaced as needed. Appropriate key locks may be provided to lock the dispensers and/or the receptacle to prevent unauthorized access thereto.

Figure 1:
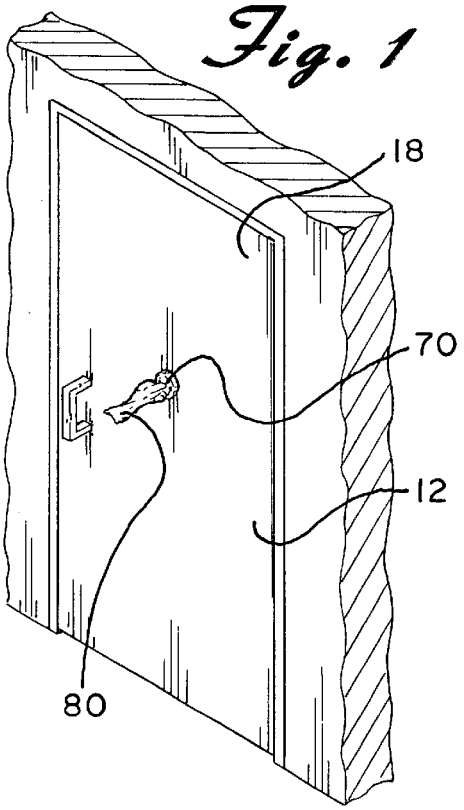
FIG. 1 illustrates the front side of a door with the opening of the disposal passage of the present invention extending therethrough.

In order to use the device of the present invention, as a person exits an enclosed area such as a public restroom, hospital room, doctor's office, etc., he/she removes a hand shield from one of the housings 22, 24, or 26 via opening 60, 62, or 64 and covers his/her hand with the shield. The person uses the covered hand to open the door 12 via the handle 78. Once the person has left the room, he/she disposes of the hand shield through the opening 70 located in the front side 18 of the door 12. (See FIG. 1.) The vacuum source 76 sucks the used hand shield 80 through the passage 68 and deposits the same into the receptacle 72. (See FIGS. 1 and 4.)

The vacuum may be activated automatically when the door is opened through the use of a limit switch or the like that is tripped when the door is opened and stays on for a fixed period of time such as thirty seconds. This will give the person leaving the restroom sufficient time to dispose of his or her hand shield after closing the door and before the vacuum turns off. Alternatively, the vacuum may be activated when a sensor senses the presence of a tissue located in the opening. Other means for activating the vacuum well known in the art may be used.

Figure 5:
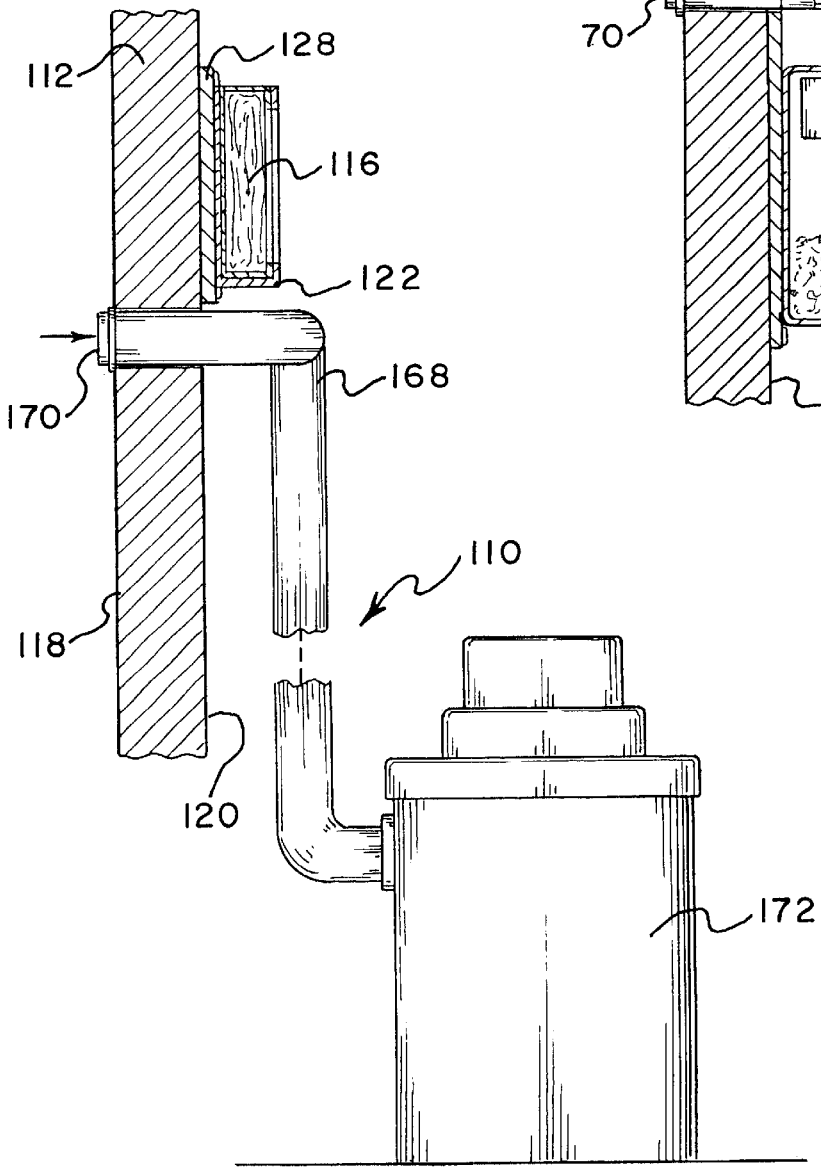
FIG. 5 is a partial cross-sectional view of a second embodiment of the present invention where the vacuum disposal receptacle is located remotely from the door.

A second embodiment of the present invention is shown in FIG. 5. The device 110 of this embodiment is similar in function and structure to the device described in the first embodiment with the differences noted below.

In this embodiment, the dispenser includes a plurality of housings, seen as housing 122, where each housing stores hand shields 116. The housings are mounted to a backing 128 located in the vicinity of the back side 120 of the door 112. A disposal passage 168 extends from inside the enclosed area to the outside of the enclosed area, for example, through the door 112 and may be in the form of a hose. The hose 168 has an opening 170 located in the vicinity of the front side 118 of the door 112. The hose 168 connects to the receptacle 172 located generally below the housings. However, in this embodiment the receptacle may be located within the room and need not be mounted to the door. Again, as described in the first embodiment, the vacuum source is stored within the receptacle and may be activated in any of the ways described above.

It should be realized that while the dispenser and disposal system in both embodiments have been described to be used in combination with a door of a room, other combinations are possible. For example, the dispenser and disposal system may be used with a wall or other types of room partitions, such as a restroom stall door.

Also, reference to the dispenser or housing being mounted in the vicinity of or adjacent the door and reference to the opening of the disposal passage located in the vicinity of or adjacent the door are not intended to be limited to the door per se. That is, the housing or dispenser could be mounted on the wall next to the door such as shown in the Katsanevas referred to above. Similarly, the disposal passage could be through the wall next to the door with the vacuum opening 70 readily accessible by the person leaving the restroom through the door 12. Combinations of these arrangements are also intended to be included in the expressions vicinity of the door or adjacent the door. That is, the dispenser or housings may be mounted on the door or on the wall while the opening is located in the wall or in the door.

The present invention may be embodied in other specific forms without departing from the spirit or essential attributes thereof and accordingly, reference should be made to the appended claims rather than to the foregoing specification as indicating the scope of the invention.

I claim:

1. The combination of a door for a generally enclosed area and a dispenser for storing a plurality of hand shields comprising:

a door having a front side and a back side;

a dispenser including a housing, said dispenser being mounted in the vicinity of the back side of said door;

a plurality of hand shields stored within said housing and said housing having means for dispensing said hand shields;

a disposal passage extending from inside the enclosed area to outside the enclosed area and having an opening in the vicinity of the front side of said door; and a receptacle in communication with said disposal passage and having a vacuum source for collecting and housing used hand shields.

2. The combination of a door and hand shield dispenser of claim 1 wherein said dispenser includes a plurality of housings with a plurality of hand shields stored within each of said housings.

3. The combination of a door and hand shield dispenser of claim 2 wherein each of said housings has a generally rectangular shape with an open top end, a back wall mounted to the back side of said door, and a front wall.

4. The combination of a door and hand shield dispenser of claim 3 wherein said dispensing means is located in said front wall and includes a generally elongated opening.

5. The combination of a door and hand shield dispenser of claim 1 wherein said hand shields include tissues, towelettes, or gloves.

6. The combination of a door and hand shield dispenser of claim 1 wherein said disposal passage includes a hose.

7. The combination of a door and hand shield dispenser of claim 1 wherein said receptacle is mounted to said door.

8. The combination of a door and hand shield dispenser of claim 1 wherein said receptacle is positioned at a location remote from said door.

9. The combination of a door and hand shield dispenser of claim 1 wherein said dispenser is mounted on the back side of said door.

10. The combination of a door and hand shield dispenser of claim 1 wherein the said disposal passage passes through said door and said opening is located on the front side of said door.

* * * * *